US007503686B2

(12) United States Patent
Tarmann et al.

(10) Patent No.: US 7,503,686 B2
(45) Date of Patent: Mar. 17, 2009

(54) APPARATUS AND METHOD FOR MIXING FLUIDS AT THE SURFACE FOR SUBTERRANEAN TREATMENTS

(75) Inventors: Paul G. Tarmann, Billings, MT (US); Michael B. Doolin, Sr., Billings, MT (US)

(73) Assignee: Paradox Holding Company, LLC, Billings, MT (US)

( * ) Notice: Subject to any disclaimer, the term of this patent is extended or adjusted under 35 U.S.C. 154(b) by 241 days.

(21) Appl. No.: 11/456,567

(22) Filed: Jul. 11, 2006

(65) Prior Publication Data

US 2008/0013401 A1 Jan. 17, 2008

(51) Int. Cl.
*B01F 5/04* (2006.01)
*B01F 5/06* (2006.01)

(52) U.S. Cl. ..... 366/173.1; 366/174.1; 366/181.5

(58) Field of Classification Search ..... 366/162.1, 366/167.1, 173.1, 173.2, 174.1, 175.2, 181.5, 366/336–340; 137/896
See application file for complete search history.

(56) References Cited

U.S. PATENT DOCUMENTS

| | | | | |
|---|---|---|---|---|
| 2,831,754 | A * | 4/1958 | Manka | 423/658.5 |
| 3,727,691 | A | 4/1973 | Muecke et al. | |
| 3,746,088 | A | 7/1973 | Haskin et al. | |
| 4,031,955 | A | 6/1977 | Ledet | |
| 4,064,941 | A | 12/1977 | Smith | |
| 4,372,386 | A | 2/1983 | Rhoades et al. | |
| 4,408,890 | A * | 10/1983 | Beckmann | 366/155.2 |
| 4,580,634 | A | 4/1986 | Cruise | |
| 4,582,131 | A | 4/1986 | Plummer et al. | |
| 4,616,937 | A | 10/1986 | King | |
| 4,648,455 | A | 3/1987 | Luke | |
| 4,749,034 | A | 6/1988 | Vandevier et al. | |
| 4,753,535 | A | 6/1988 | King | |
| 4,966,235 | A | 10/1990 | Gregoli et al. | |
| 5,176,448 | A | 1/1993 | King et al. | |
| 5,190,103 | A | 3/1993 | Griston et al. | |
| 5,320,500 | A | 6/1994 | Cholet | |
| 5,597,236 | A | 1/1997 | Fasano | |
| 5,655,895 | A | 8/1997 | Warth et al. | |
| 6,027,241 | A | 2/2000 | King | |
| 6,089,317 | A | 7/2000 | Shaw | |
| 6,138,758 | A | 10/2000 | Shaw et al. | |

(Continued)

FOREIGN PATENT DOCUMENTS

DE 19932276 A1 * 1/2001

*Primary Examiner*—Charles E Cooley
(74) *Attorney, Agent, or Firm*—Antoinette M. Tease

(57) ABSTRACT

A mixing device comprising three mixing assemblies and first and second horizontal inlet arms, wherein the mixing assemblies are arranged horizontally on a frame, with one mixing assembly on the bottom, one on the top, and one in the middle of the other two mixing assemblies. Each mixing assembly comprises a first housing, a second housing, and a swedge. In a preferred embodiment, the ratio of the inside diameter of the first housing to the inside diameter of the second housing is 1:2, the change in diameter between the first and second housing is abrupt, and the first housing extends into the second housing by a certain distance. Inside the first housing are an inlet agitator and injection nozzle, and inside the second housing is a static mixer. The injection nozzle is located proximate to the point at which the change in diameter occurs between the first and second housing.

34 Claims, 11 Drawing Sheets

U.S. PATENT DOCUMENTS 6,190,141 B1 2/2001 Henry
6,222,083 B1 4/2001 Colle
6,260,628 B1 7/2001 Magnus
6,279,611 B2 * 8/2001 Uematsu et al. ..... 137/888
6,305,835 B1 * 10/2001 Farrar et al. ..... 366/162.4
6,698,917 B2 3/2004 Etchells, III et al.
2003/0127228 A1 7/2003 Stone
2008/0013401 A1 * 1/2008 Tarmann et al. ..... 366/174.1

* cited by examiner

APPARATUS AND METHOD FOR MIXING FLUIDS AT THE SURFACE FOR SUBTERRANEAN TREATMENTS

BACKGROUND OF THE INVENTION

1. Field of the Invention

This invention relates to the field of fluid mixing, and more specifically, to an apparatus and method for mixing fluids at the surface for the treatment of subterranean conditions.

2. Description of the Related Art

A variety of methods and apparatus have evolved for the purpose of treating oil and gas well formations intended to modify the well bore in-flow characteristics of marginally producing wells. The majority of these apparatus and methods involves positioning a work-over rig over the wellhead and installing and/or removing downhole tubing and equipment to be able to reach the formation with the chemicals. This downhole equipment provides adequate delivery at the expense of long well downtimes and high treatment costs. These factors prevent the use of these apparatus and methods for treatment of marginal producing wells whose incremental production economics are unfavorable for expensive treatments.

For marginal producing wells, the prior methodology involves either injecting the chemicals directing into the flow lines or mixing treatment chemicals in truck-mounted tanks for injection into the formation. Both methodologies result in poor intermixing of the chemicals, and neither method offers a safe way to heat flammable solvents and chemical inhibitors prior to injection.

An additional problem associated with mixing carrier fluids and chemicals in truck-mounted tanks is that oilfield water hauling trucks and tanks are routinely used for many applications that do not leave the empty tank clean after the job is done. If a solvent or inhibitor is mixed with carrier fluid inside the tank, the residue from the previous job may be dispersed within the water or oil that is used as the carrier fluid. This can result in a significant reduction in the effectiveness of the solvents and/or inhibitors that are used.

The fluid systems employed for marginal formation treatment typically consist of a carrier fluid in which a chemical is mixed. Carrier fluids employed for formation treatment are generally produced fluids, such as produced water, crude oil, or natural gas condensates. These fluids are often heated to reduce fluid viscosity and improve formation penetration.

The chemicals used for treatment include solvents, inhibitors, polymers, acids, and wetting agents. Each of these must be well mixed to be effective. For example, polymerization for sand control involves mixing a catalyst agent with a resin, which results in a highly exothermic reaction that produces the polymer that binds the sand grains together to form a permeable boundary near the well bore. Pre-mixing these chemicals requires temperature control methods to chill the fluids and prevent hazardous conditions in the mix tanks. Mixing these reactants in-situ often results in poor performance due to inadequate mixing in the formation.

Marginal wells often suffer from materials plugging of the formation. These plugging foulants may be paraffins in certain crude oil fields, minerals in water flood fields, or hydrates in natural gas fields. Paraffinic foulants are typically treated with chemicals mixed with a hot oil carrier fluid to liquify the paraffin and keep it in solution as it is carried out of the formation. Mineral foulants are treated with acid mixed into a water carrier. Corrosion inhibitor is added to the mixed solution to protect the well tubing string from the acid. It has been previously documented that hydrate blocking may be dissolved using heated carrier fluids and solvents along with various chemicals to inhibit the reformation of the hydrate.

The present invention solves these and other problems by effectively, cleanly and safely mixing chemicals with the carrier fluid at the surface and injecting the mixture down the well bore. Several objects of this invention are listed below.

It is an object of the present invention to improve daily production operations performance and reduce maintenance costs in oil and gas field projects.

It is a further object of the present invention to provide a means for mechanically mixing fluids in a field setting.

Yet another object of the present invention is to offer controlled mixing and proportioning of fluids that vary in temperature, viscosity and density.

It is a further object of the present invention to provide a safe method of heat exchange by injecting solvents and inhibitors into a heated stream of carrier fluid.

Yet another object of the present invention is to allow more than one chemical to be injected and effectively mixed in the carrier fluid.

It is a further object of the present invention to enable the mixing of carrier fluids and chemicals in a clean environment so as to avoid residue from previous jobs.

Yet another object of the present invention is to provide a means for dealing effectively with in-situ mineral scale deposition, paraffin buildup, metal sulfide plugging, water and condensate banking, methane hydrate blocking, and emulsion blocking, among other problems.

It is a further object of the present invention to improve the mixing of drilling additives used to control bore hole stability in the water well drilling industry.

Yet another object of the present invention to offer a fluid mixing apparatus that is portable.

It is a further object of the present invention to offer a mixing apparatus and a stimulation method that are economically viable for marginal well operations.

BRIEF SUMMARY OF THE INVENTION

The present invention is a mixing device comprising a first housing, a second housing, a swedge, an inlet for carrier fluid, and an inlet for chemicals, wherein the ratio of the inside diameter of the first housing to the inside diameter of the second housing is 1:2, wherein the change in diameter between the first and second housing is abrupt, wherein inside the first housing are an inlet agitator and an injection nozzle, wherein inside the second housing is a static mixer, and wherein the swedge is connected to tubing that delivers a mixture of carrier fluid and chemical down a well bore. The injection nozzle is preferably located proximate to the point at which the change in diameter occurs between the first and second housing.

In a preferred embodiment, the first and second housing each has an inside diameter, the inside diameter of the first housing is one inch, and the inside diameter of the second housing is two inches. Preferably, the first housing extends into the second housing by a distance in the range of one-eighth (⅛) to one and one-half (1½) inches.

In an alternate embodiment of the present invention, the mixing device comprises two mixing assemblies, a horizontal connector arm, a first horizontal inlet arm, and a second horizontal inlet arm, wherein the mixing assemblies are arranged horizontally on a frame, with one mixing assembly on top of the other and the horizontal connector arm between the two mixing assemblies, wherein one end of each mixing assembly is connected to a first riser and the other end of each mixing assembly is connected to a second riser, wherein one end of the horizontal connector arm is connected to the second riser and the other end of the horizontal connector arm is connected to a third riser, wherein the third riser connects the horizontal connector arm to the bottom-most mixing assembly, wherein the first horizontal inlet arm extends horizontally from the end of the top-most mixing assembly that connects to the first riser, and wherein the second horizontal inlet arm extends horizontally from the end of the bottom-most mixing assembly that connects to the first riser.

In a preferred embodiment, each mixing assembly comprises a first housing, a second housing, and a swedge, wherein the first and second housing each has an inside diameter, wherein the ratio of the inside diameter of the first housing to the inside diameter of the second housing is 1:2, wherein the change in diameter between the first and second housing is abrupt, wherein inside the first housing are an inlet agitator and an injection nozzle, and wherein inside the second housing is a static mixer. The injection nozzle is preferably located proximate to the point at which the change in diameter occurs between the first and second housing.

In a preferred embodiment, the first and second housing each has an inside diameter, the inside diameter of the first housing is two inches, and the inside diameter of the second housing is four inches. Preferably, the first housing extends into the second housing by a distance in the range of one-eighth (⅛) to two and one-half (2½) inches.

In a preferred embodiment, an injection assembly is attached to the first housing of each mixing assembly, and the injection assembly comprises a check valve, an inlet valve, a needle valve, and the injection nozzle. Preferably, a pressure gauge is attached to each injection assembly.

In a preferred embodiment, the mixing device further comprises a check valve, wherein the check valve is located opposite the end of the bottom-most mixing assembly from the second horizontal inlet arm, and wherein the check valve is connected to tubing that delivers a mixture of carrier fluid and chemical down a well bore.

In a preferred embodiment, each of the first and second horizontal inlet arms comprises a pressure regulator, a flow control valve, an air/accessory valve, a flow meter, and a block valve.

In a preferred embodiment, each mixing assembly further comprises a pair of primary flanges and a pair of secondary flanges, wherein the horizontal connector arm comprises two pairs of secondary flanges, wherein each pair of flanges is bolted together when the mixing device is assembled, and wherein the flanges can be separated to disassemble the mixing device.

In a preferred embodiment, the mixing device further comprises a bleeder valve on either end of the second riser.

In yet another embodiment of the present invention, the mixing device comprises three mixing assemblies, a first horizontal inlet arm, and a second horizontal inlet arm, wherein the mixing assemblies are arranged horizontally on a frame, with one mixing assembly on the bottom, one mixing assembly on the top, and one mixing assembly in the middle of the other two mixing assemblies, wherein one end of the top-most and bottom-most mixing assemblies is connected to a first riser and the other end of the top-most and bottom-most mixing assemblies is connected to a second riser, wherein one end of the middle mixing assembly is connected to the second riser and the other end of the middle mixing assembly is connected to a third riser, wherein the third riser connects the middle mixing assembly to the bottom-most mixing assembly, wherein the first horizontal inlet arm extends horizontally from the end of the top-most mixing assembly that connects to the first riser, and wherein the second horizontal inlet arm extends horizontally from the end of the bottom-most mixing assembly that connects to the first riser.

In a preferred embodiment, each mixing assembly comprises a first housing, a second housing, and a swedge, wherein the first and second housing each has an inside diameter, wherein the ratio of the inside diameter of the first housing to the inside diameter of the second housing is 1:2, wherein the change in diameter between the first and second housing is abrupt, wherein inside the first housing are an inlet agitator and an injection nozzle, and wherein inside the second housing is a static mixer. Preferably, the injection nozzle is located proximate to the point at which the change in diameter occurs between the first and second housing.

In a preferred embodiment, the first and second housing each has an inside diameter, the inside diameter of the first housing is two inches, and the inside diameter of the second housing is four inches. Preferably, the first housing extends into the second housing by a distance in the range of one-eighth (⅛) to two and one-half (2½) inches.

In a preferred embodiment, an injection assembly is attached to the first housing of each mixing assembly, and the injection assembly comprises a check valve, an inlet valve, a needle valve, and the injection nozzle. Preferably, a pressure gauge is attached to each injection assembly.

In a preferred embodiment, the mixing device further comprises a check valve, wherein the check valve is located opposite the end of the bottom-most mixing assembly from the second horizontal inlet arm, and wherein the check valve is connected to tubing that delivers a mixture of carrier fluid and chemical down a well bore.

In a preferred embodiment, each of the first and second horizontal inlet arms comprises a pressure regulator, a flow control valve, an air/accessory valve, a flow meter, and a block valve.

In a preferred embodiment, each mixing assembly further comprises a pair of primary flanges and a pair of secondary flanges, wherein each pair of flanges is bolted together when the mixing device is assembled, and wherein the flanges can be separated to disassemble the mixing device.

In a preferred embodiment, the mixing device further comprises a bleeder valve on either end of the second riser.

The present invention includes a method of mixing a carrier fluid with a chemical comprising injecting a carrier fluid through the carrier fluid inlet of the mixing device and injecting a chemical through the chemical inlet of the mixing device.

The present invention also includes a method of mixing a carrier fluid with one or more chemicals comprising injecting a carrier fluid through the first or second horizontal inlet arm of the mixing device and injecting one or more chemicals through one or more of the injection assemblies of the mixing assemblies of the mixing device.

The present invention also includes a method of mixing a carrier fluid with a chemical comprising injecting the chemical through the first or second horizontal inlet arm of the mixing device and injecting the carrier fluid through one or the injection assemblies of the mixing assemblies of the mixing device.

REFERENCE NUMBERS

Figure 1:
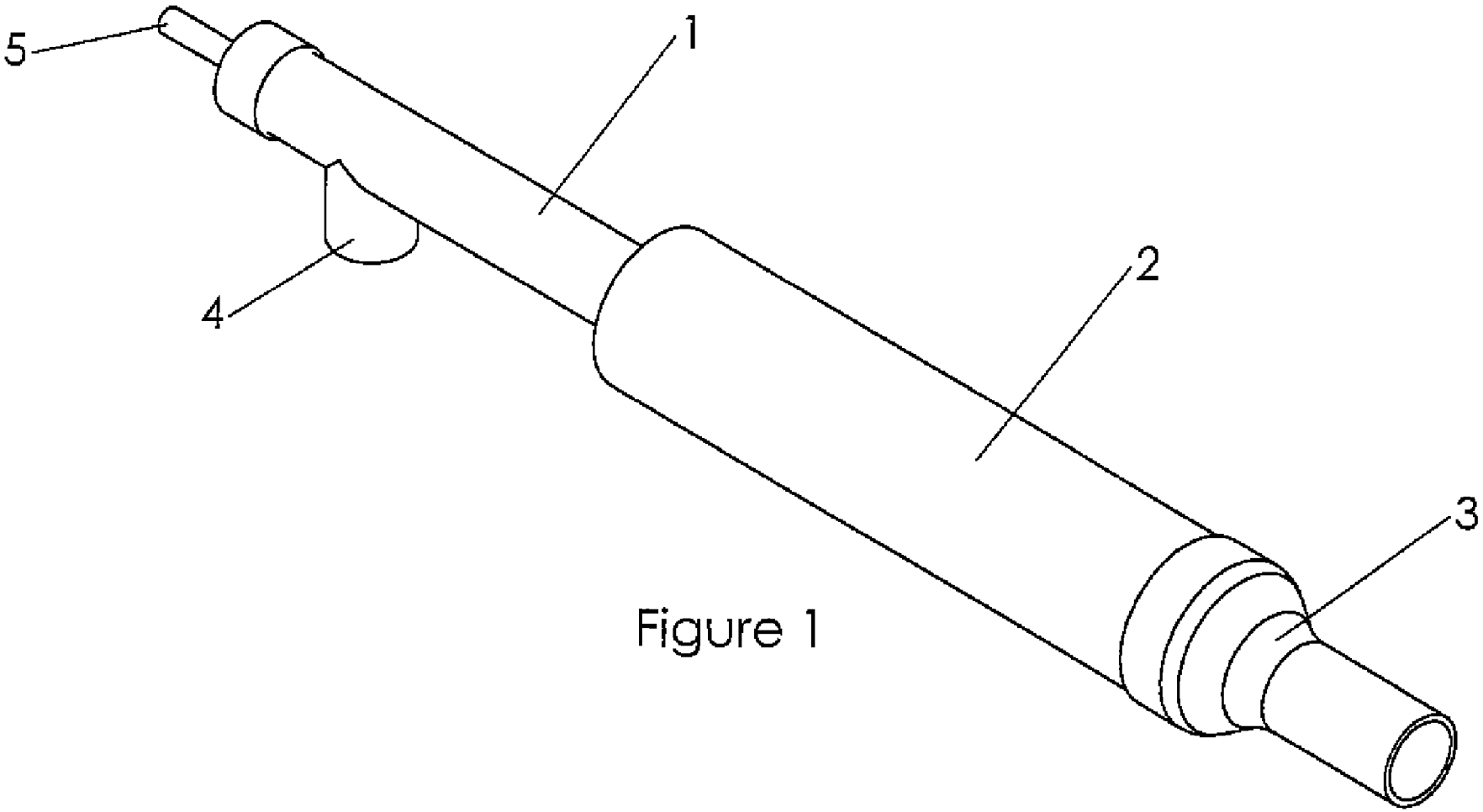
FIG. 1 is a perspective view of a first embodiment of the present invention.

1 First housing
2 Second housing
3 Swedge
4 Inlet (for carrier fluid)
5 Inlet (for chemical)
6 Inlet agitator
7 Injection nozzle
8 Static mixer
9 Mixing assembly
10 First housing
11 Primary flange
12 Secondary flange
13 Second housing
14 Swedge
15 Injection
15*a* Inlet valve
15*b* Needle valve
15*c* Injection nozzle
15*d* Check valve
16 Pressure gauge
17 First horizontal inlet arm
17*a* Second horizontal inlet arm
18 Flow control valve
19 Pressure regulator
20 Air/accessory valve
21 Flow meter
22 Block valve
23 First riser
24 Second riser
25 Bleeder valve
26 Horizontal connector arm
26*a* Third riser
27 Check valve
28 Frame
29 Inlet agitator
30 Static mixer

DETAILED DESCRIPTION OF INVENTION

The present invention is a method and apparatus for proportioning and intermixing two or more fluids on the surface to produce a consistent composition for injection into the subterranean formation utilizing the existing well tubing and/or casing. Although the present invention has particular utility in the oil and gas industry, it may have other applications as well, for example, in water well drilling. With the present invention, mixing is accomplished through an in-line pressure mixing chamber, as opposed to pumping treatment chemicals directly into flow lines that have very little inherent turbulence or in tank trucks that are notoriously dirty and cannot provide effective mixing of fluids.

As described more fully below, one embodiment of the present invention is a compact production version of the mixing device, which is preferably permanently fixed to the wellhead. This embodiment is intended to allow for the routine introduction of inhibitors in connection with daily production operations, but it is not intended to handle high pressures. It is anticipated that the compact mixer will be permanently fixed within a production plumbing system and will provide improved operations performance and reduced maintenance costs over time. The operating pressure range for this embodiment is zero to 300 psi with an intermittent peak maximum of 500 psi.

Another embodiment of the present invention is a high-pressure, portable unit that can be used to inject more than one chemical into the carrier fluid. This particular embodiment may have two or three static mixers, as described more fully below. The operating pressure range for this embodiment is zero to 1500 psi with an intermittent peak maximum of 2200 psi.

FIG. 1 is a perspective view of a first embodiment of the present invention. This embodiment is a mixing device intended for use in daily production operations. The mixing device preferably comprises a first housing 1, a second housing 2, a swedge 3, an inlet 4 for the carrier fluid, and an inlet 5 for the chemicals to be added to the carrier fluid. The swedge 3 in turn is connected to tubing (not shown) that delivers the mixture of carrier fluid and chemical down the well bore. In this embodiment, the ratio of the inside diameter of the first housing 1 to the inside diameter of the second housing 2 is preferably 1:2. For example, in a preferred embodiment, the inside diameter of the first housing 1 is one inch, and the inside diameter of the second housing 2 is two inches.

Figure 2:
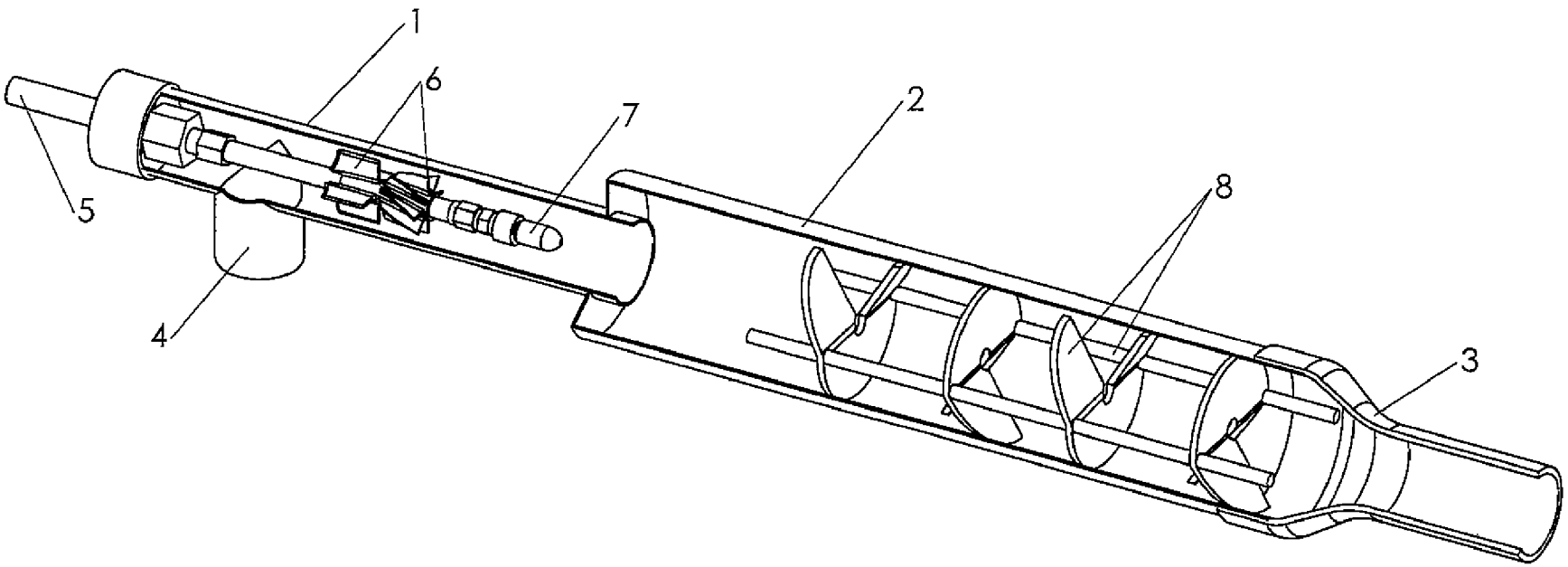
FIG. 2 is a perspective section view of a first embodiment of the present invention.

FIG. 2 is a perspective section view of a first embodiment of the present invention. This figure provides a view into the inside of the device shown in FIG. 1. As shown in FIG. 2, inside the first housing 1 are an inlet agitator 6 and an injection nozzle 7. Inside the second housing 2 is a static mixer 8. The present invention is not limited to any particular shape or configuration of the static mixer 8 or inlet agitator 6, as long as they serve the purpose of increasing the turbulence of the fluids inside the mixing device. The shapes shown in FIG. 2 are for illustrative purposes only.

The purpose of the inlet agitator 6 is to create turbulence in the carrier fluid after it enters the first housing 1 through the inlet 4. The purpose of the static mixer 8 is to further mix the carrier fluid and injected chemical before the mixture passes through the swedge 3 and into the well bore.

The diameter of the second housing 2 is preferably larger than the diameter of the first housing 1, thereby creating additional turbulence at the point at which the fluids leave the first housing 1 and enter the second housing 2. To achieve the best mixing, this change in diameter is preferably abrupt, as shown in FIG. 2, and not tapered. The injection nozzle 7 is preferably located proximate to the point at which the change in diameter occurs between the first 1 and second 2 housing.

Figure 3:
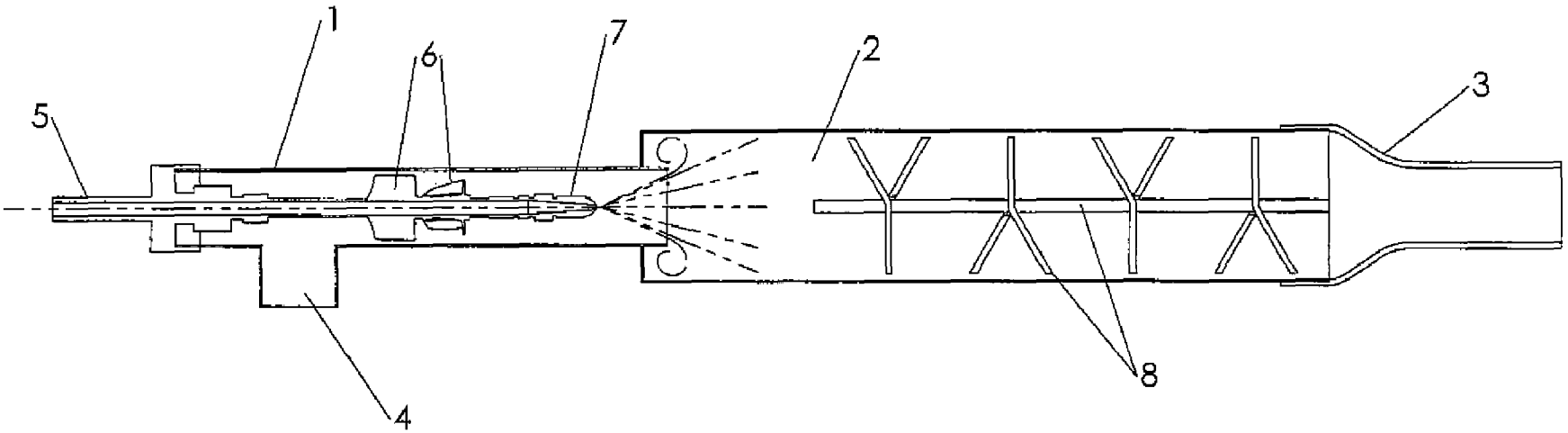
FIG. 3 is a section view of a first embodiment of the present invention.

In addition, as shown in FIGS. 2 and 3, the first housing 1 preferably extends into the second housing 2 by a distance in the range of one-eighth (⅛) to one and one-half (1½) inches.

By extending the first housing 1 into the second housing 2 in this manner, further turbulence is created, thereby contributing to the mixing effect.

Figure 4:
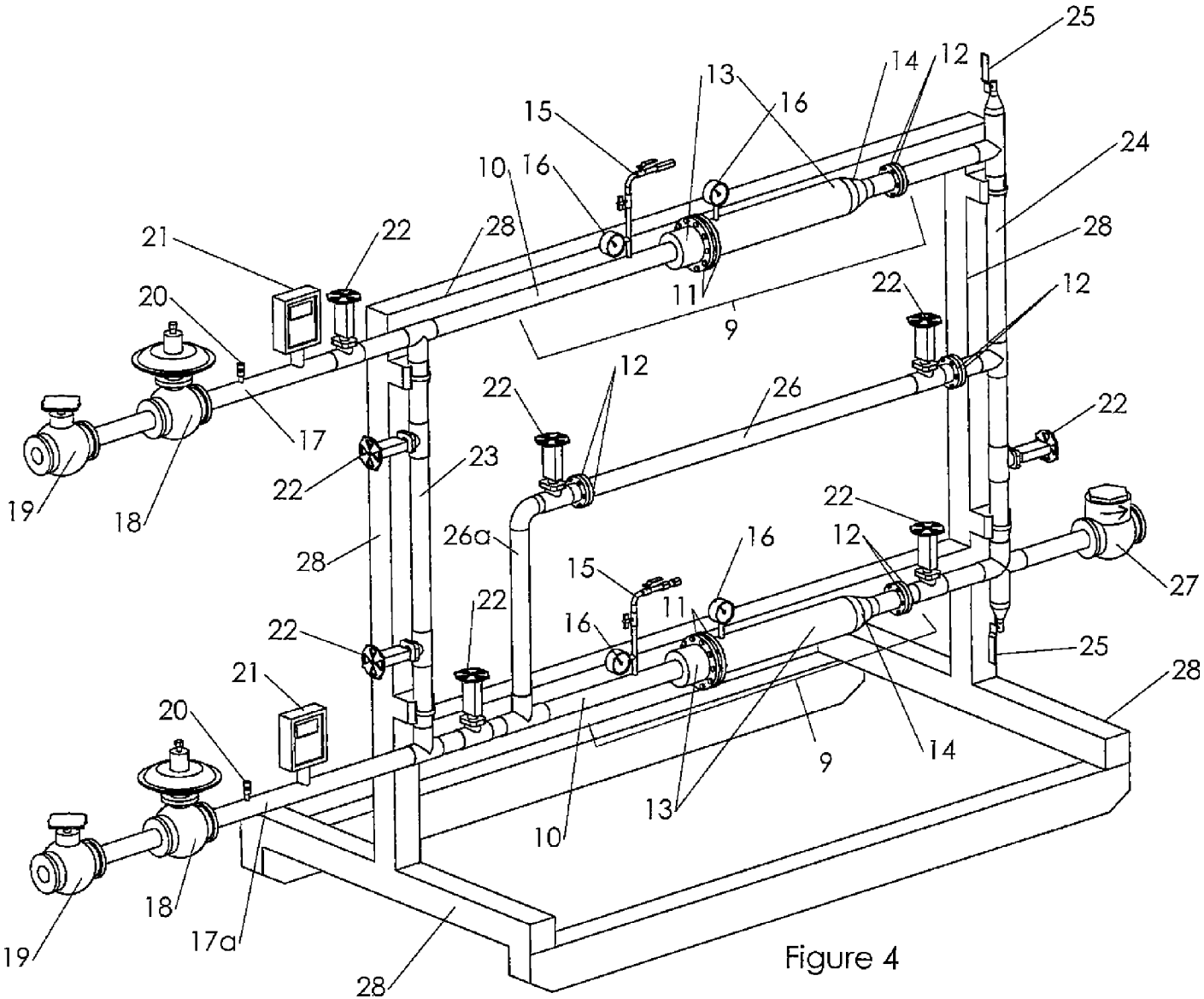
FIG. 4 is a perspective view of a second embodiment of the present invention.

FIG. 4 is a perspective view of a second embodiment of the present invention. This embodiment is a portable mixing device intended for use when high pressure applications are needed. In a typical situation, this embodiment of the mixing device would be used to treat fifty (50) to sixty (60) forty-two (42)-gallon barrels of carrier fluid at a time.

This embodiment comprises two mixing assemblies arranged horizontally on a frame 28, one on top of the other, with a horizontal connector arm 26 between them. One end of each mixing assembly is connected to a first riser 23, and the other end of each mixing assembly is connected to a second riser 24. One end of the horizontal connector arm 26 is connected to the second riser 24, and the other end of the horizontal connector arm 26 is connected to a third riser 26*a*. The third riser 26*a* connects the horizontal connector arm 26 to the bottom-most mixing assembly 9. The present invention is not limited to any particular dimension or shape of the frame, as long as it holds the mixing device upright. In fact, the frame could be on skids (as shown in the drawings), on wheels, or truck-mounted.

Extending horizontally from the end of the top-most mixing assembly 9 that connects to the first riser 23 is a first horizontal inlet arm 17. The first horizontal inlet arm preferably comprises a pressure regulator 19, a flow control valve 18, an air/accessory valve 20, a flow meter 21, and a block valve 22. Extending horizontally from the end of the bottom-most mixing assembly 9 that connects to the first riser 23 is a second horizontal inlet arm 17*a*. The second horizontal inlet arm preferably comprises a pressure regulator 19, a flow control valve 18, an air/accessory valve 20, a flow meter 21, and a block valve 22. The purpose of the air/accessory valve 20 is to allow an air pump or other device, such as an additional pressure gauge, to be attached to the mixing device. By way of example, an air pump might be used to pump air through the system to clear it out.

The pressure regulator 19 is used to control the pressure of the incoming fluid. The flow control valve 18 is used to control the flow of the incoming fluid, which could be produced water, crude oil, methanol, natural gas condensate, or any other chemical. The flow meter 21 monitors the flow of the incoming fluid. All block valves 22 are used to allow or prevent the flow of fluid past a particular point.

Opposite the end of the bottom-most mixing assembly 9 from the second horizontal inlet arm 17*a* is a check valve 27. The check valve 27 prevents wellbore fluids, gases and pressures from traveling back into the system after they have exited the check valve 27. Although not shown, tubing preferably extends from the check valve 27 to carry the fluids from the mixing device into the well bore.

Each mixing assembly 9 preferably comprises a first housing 10, a second housing 13, and a swedge 14. In this embodiment, the ratio of the inside diameter of the first housing 1 to the inside diameter of the second housing 2 is preferably 1:2. In a preferred embodiment, the inside diameter of the first housing 10 is two inches, and the inside diameter of the second housing 13 is four inches. An injection assembly 15 is attached to the first housing 10, and a pressure gauge 16 is attached to the injection assembly 15. The injection assembly 15 preferably comprises a check valve 15*d*, an inlet valve 15*a*, and a needle valve 15*b* (see FIG. 6). The needle valve 15*b* allows for precise dosing of the fluid injected through the injection assembly 15.

Each mixing assembly 9 preferably comprises a pair of primary flanges 11 and a pair of secondary flanges 12. Similarly, the horizontal connector arm 26 preferably comprises two pairs of secondary flanges 12. Each flange in a pair is bolted to the other flange in the pair, and the flanges can be separated to allow for easy disassembly of the mixing device.

A bleeder valve 25 is preferably located on either end of the second riser 24 to allow the operator to check that the fluids are being properly mixed or to drain the system.

Figure 5:
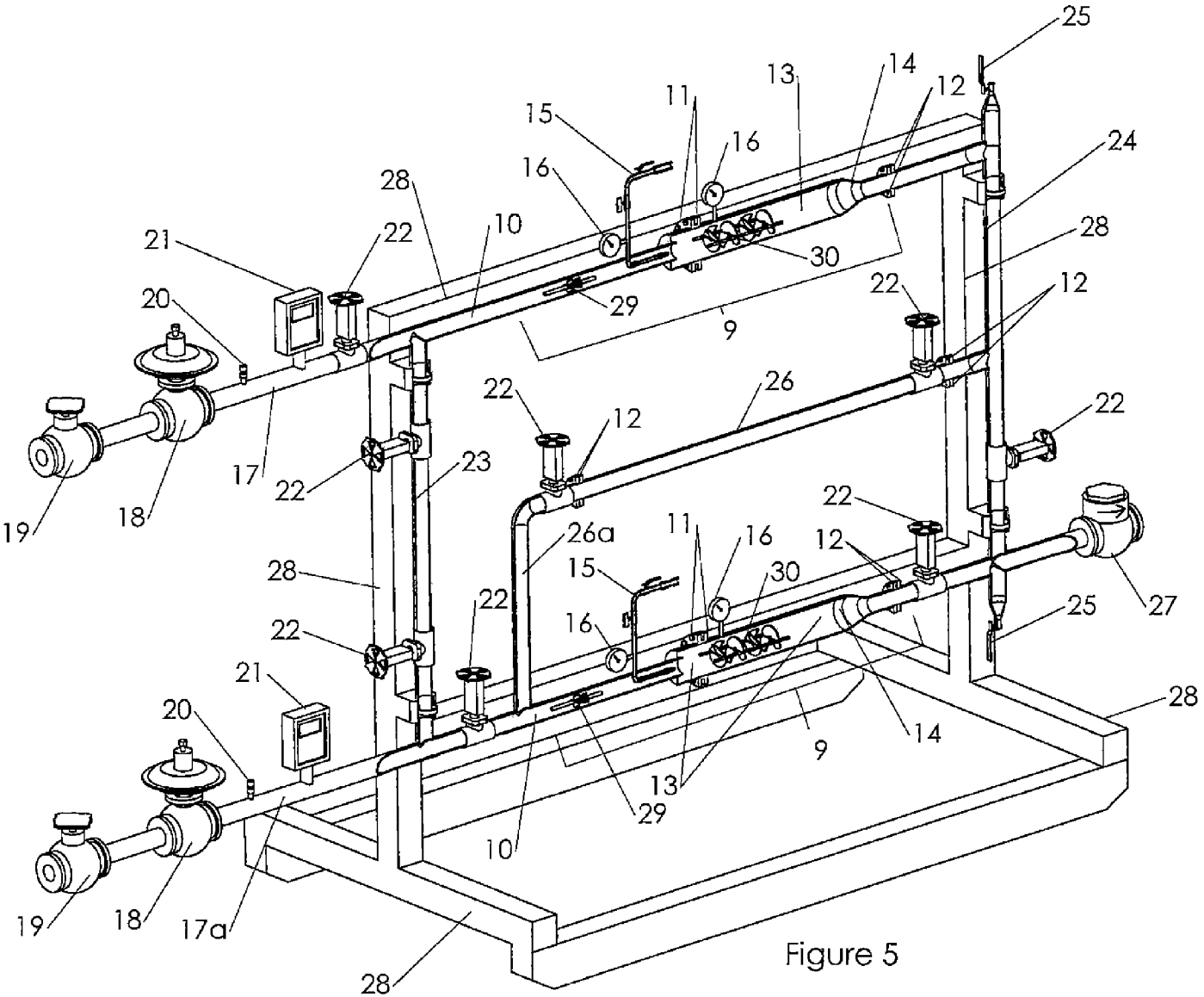
FIG. 5 is a partial section view of a second embodiment of the present invention.

FIG. 5 is a partial section view of a second embodiment of the present invention. This view shows the inside of the first 10 and second 13 housing. As with the previous embodiment an inlet agitator 29 is located inside the first housing 10, and a static mixer 30 is located inside the second housing 13. The inlet agitator 29 and static mixer 30 may be secured within the first 10 and second 13 housing, respectively, by a number of different means. For example, they may be welded inside the housing, or they may be secured with rings or spokes that protrude from the inside of the housing on either end of the inlet agitator 29 or static mixer 30.

In each of the embodiments of the present invention, the invention is not limited to any particular method of securing the inlet agitator 29 and static mixer 30 inside the housing. In theory, the static mixer could also be loose (or unsecured) within the second housing, in which case the pressure of the fluids would push it up against the swedge 3, 14. In the second embodiment (see FIG. 6), rather than being situated between the horizontal inlet arm (not shown) and the injection nozzle 15*c* the inlet agitator 29 could actually be situated on the injection nozzle 15*c* itself, similar to what is shown in FIG. 2.

Figure 6:
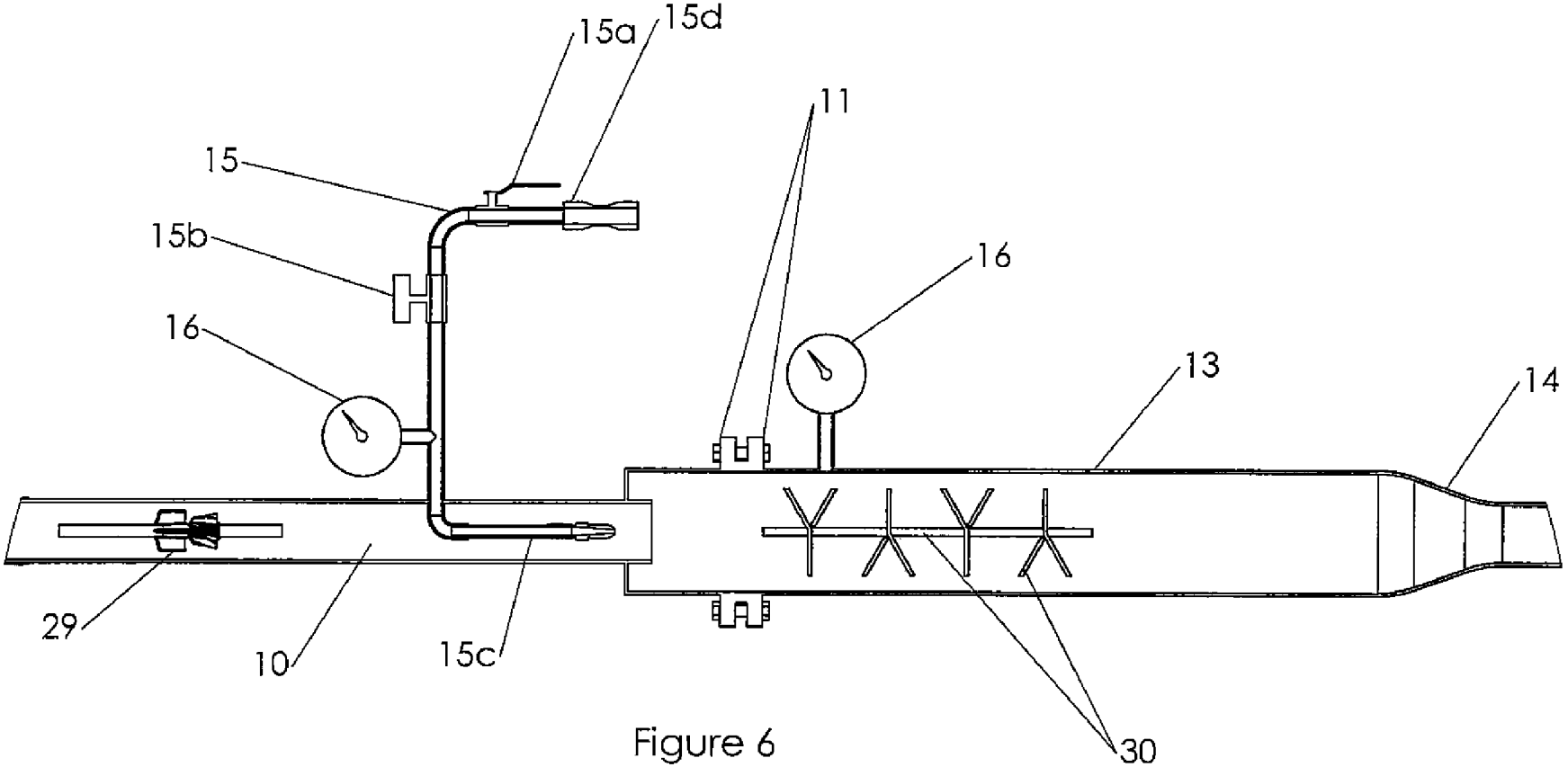
FIG. 6 is a side view of one of the mixing assemblies shown in FIG. 5.

FIG. 6 is a side view of one of the mixing assemblies shown in FIG. 5. As with the first embodiment, the change in diameter between the first 10 and second 13 housing is preferably abrupt, and the first housing 10 extends into the second housing by a distance in the range of one-eighth (⅛) to two and one-half (2½) inches. As shown in this figure, the injection assembly 15 further comprises an injection nozzle 15*c*, which preferably faces the static mixer 30 and is located proximate to the point at which the change in diameter occurs between the first 10 and second 13 housing.

Figure 7:
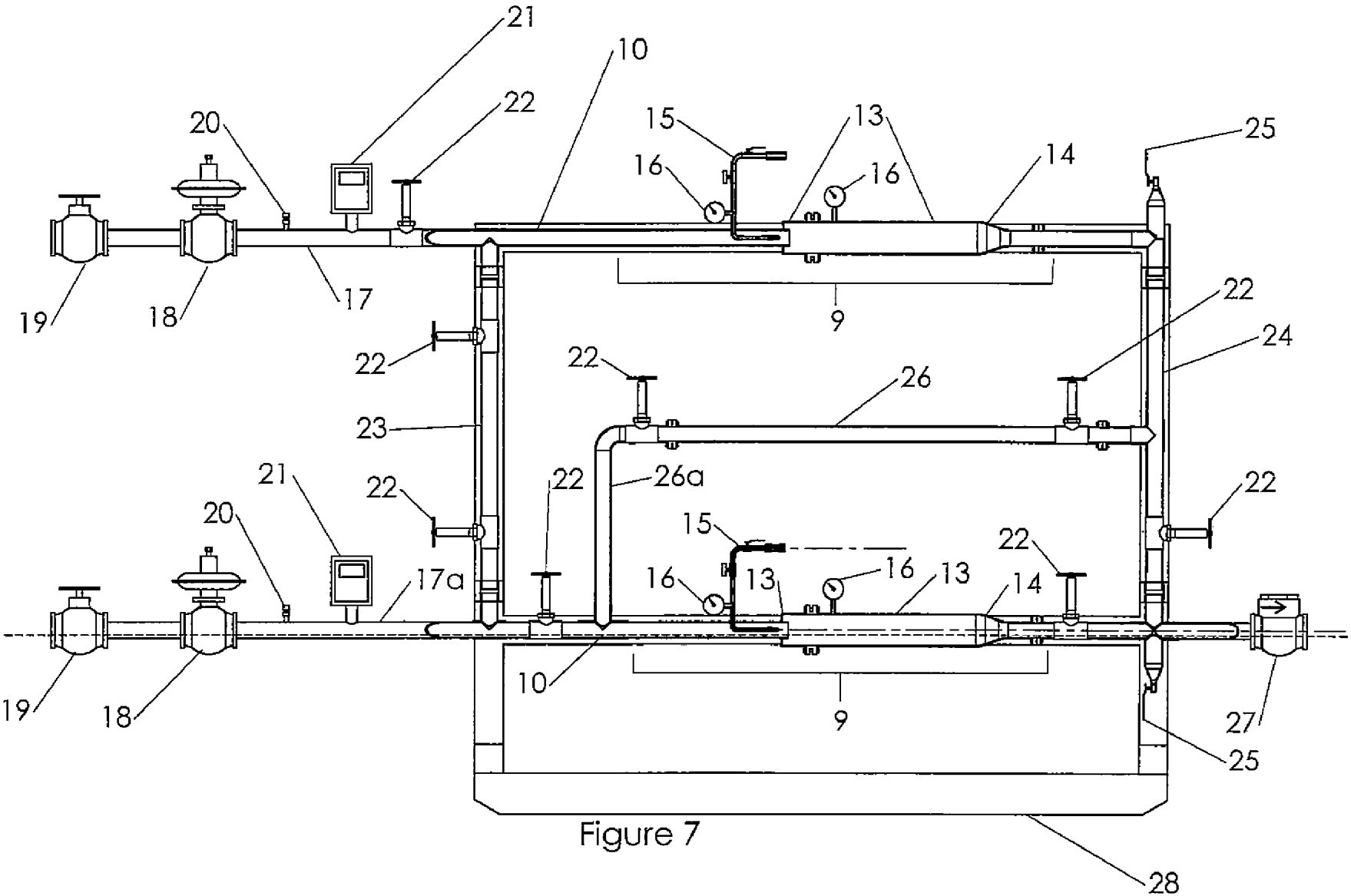
FIG. 7 is a side view of a second embodiment of the present invention showing the injection of a first chemical into a carrier fluid.
Figure 8:
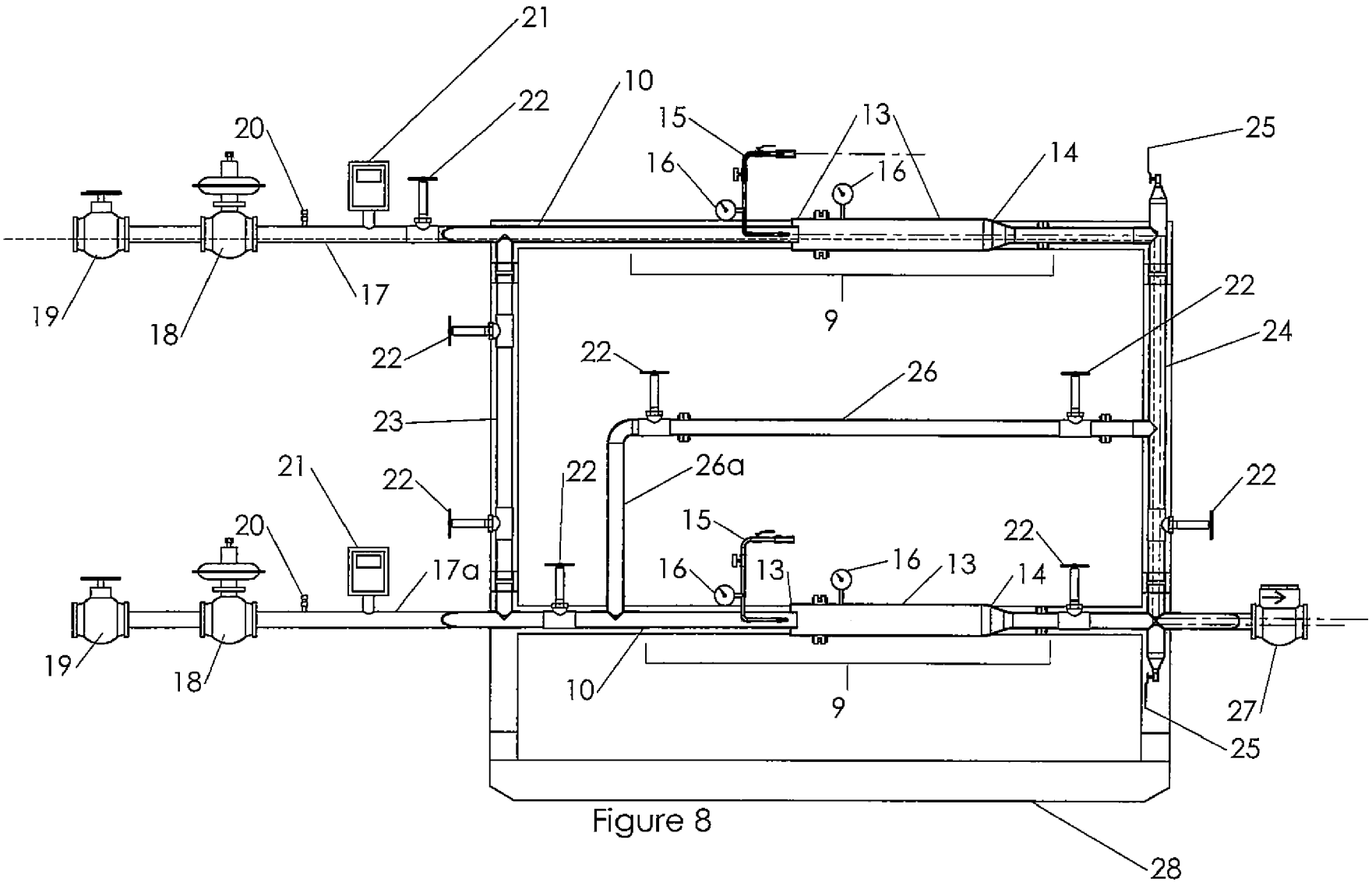
FIG. 8 is a side view of a second embodiment of the present invention showing the injection of a second chemical into a carrier fluid.
Figure 9:
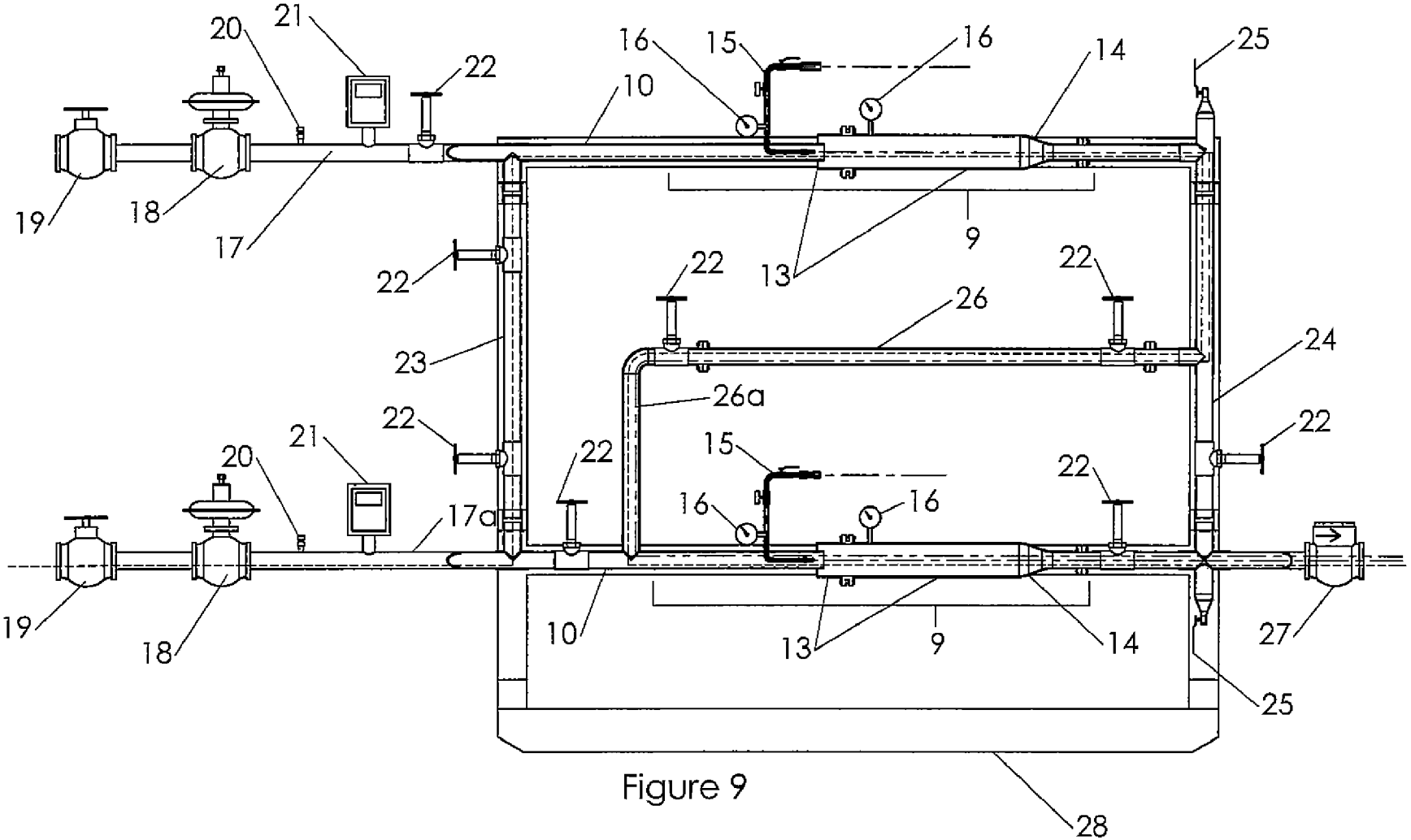
FIG. 9 is a side view of a second embodiment of the present invention showing the injection of two chemicals into a carrier fluid.

FIGS. 7 through 9 illustrate different possible uses of the mixing device. In FIG. 7, a carrier fluid enters through the second horizontal inlet arm 17*a*. A chemical (for example, an inhibitor) is injected through the injection assembly 15 on the bottom-most mixing assembly 9. The fluids pass through at least four stages of mixing. These stages include: (i) the inlet agitator 29 (see FIGS. 5 and 6); (ii) the injection nozzle 15*c* (see FIG. 6); (iii) the change in diameter between the first 10 and second 13 housing, with the first housing 10 preferably extending into the second housing 13; and (iv) the static mixer.

In a typical operational situation, the carrier fluid is heated to a temperature of 150 to 200 degrees Fahrenheit in a hot oil truck. The injected chemicals are heated inside the mixing device by virtue of being exposed to the heated carrier fluid. This method of heating the injected chemicals is much safer than current practice, in which chemicals are pumped into the hot oil truck and then heated along with the carrier fluid. The present invention allows the chemicals to be heated in a much more controlled and contained environment.

In FIG. 8, the carrier fluid is introduced through the first horizontal inlet arm 17, and a chemical is injected through the injection assembly 15 on the top-most mixing assembly 9. This particular configuration might be used, for example, to inject methanol into the carrier fluid in order to keep the methanol separate from whatever chemical is injected through the injection assembly 15 on the bottom-most mixing assembly 9.

In FIG. 9, the carrier fluid is introduced through the second horizontal inlet arm 17*a*, a first chemical is injected through the injection assembly 15 on the top-most mixing assembly 9, the fluids travel through the horizontal connector arm 26, and a second chemical is injected through the injection assembly 15 on the bottom-most mixing assembly 9. In this case, the carrier fluid could also be introduced through the first horizontal inlet arm 17.

This embodiment of the present invention may be used to achieve many different combinations of carrier fluids and/or chemicals, and the present invention is not limited to any particular combination or use. For example, the device may be used to slug water by introducing the water through the second horizontal inlet arm 17*a* and passing it through the bottom-most mixing assembly 9 and out through the check valve 27.

Figure 10:
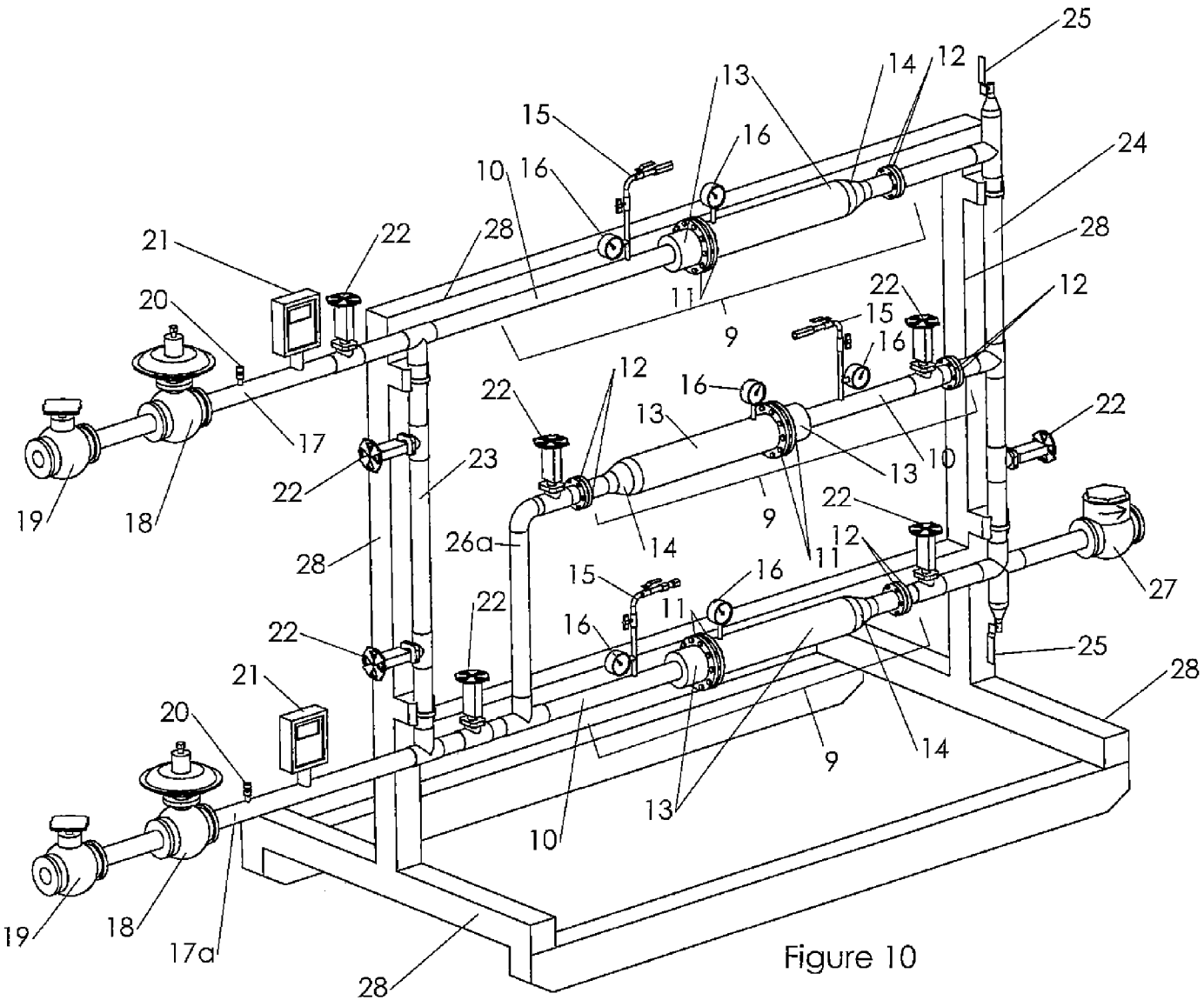
FIG. 10 is a perspective view of a third embodiment of the present invention.
Figure 11:
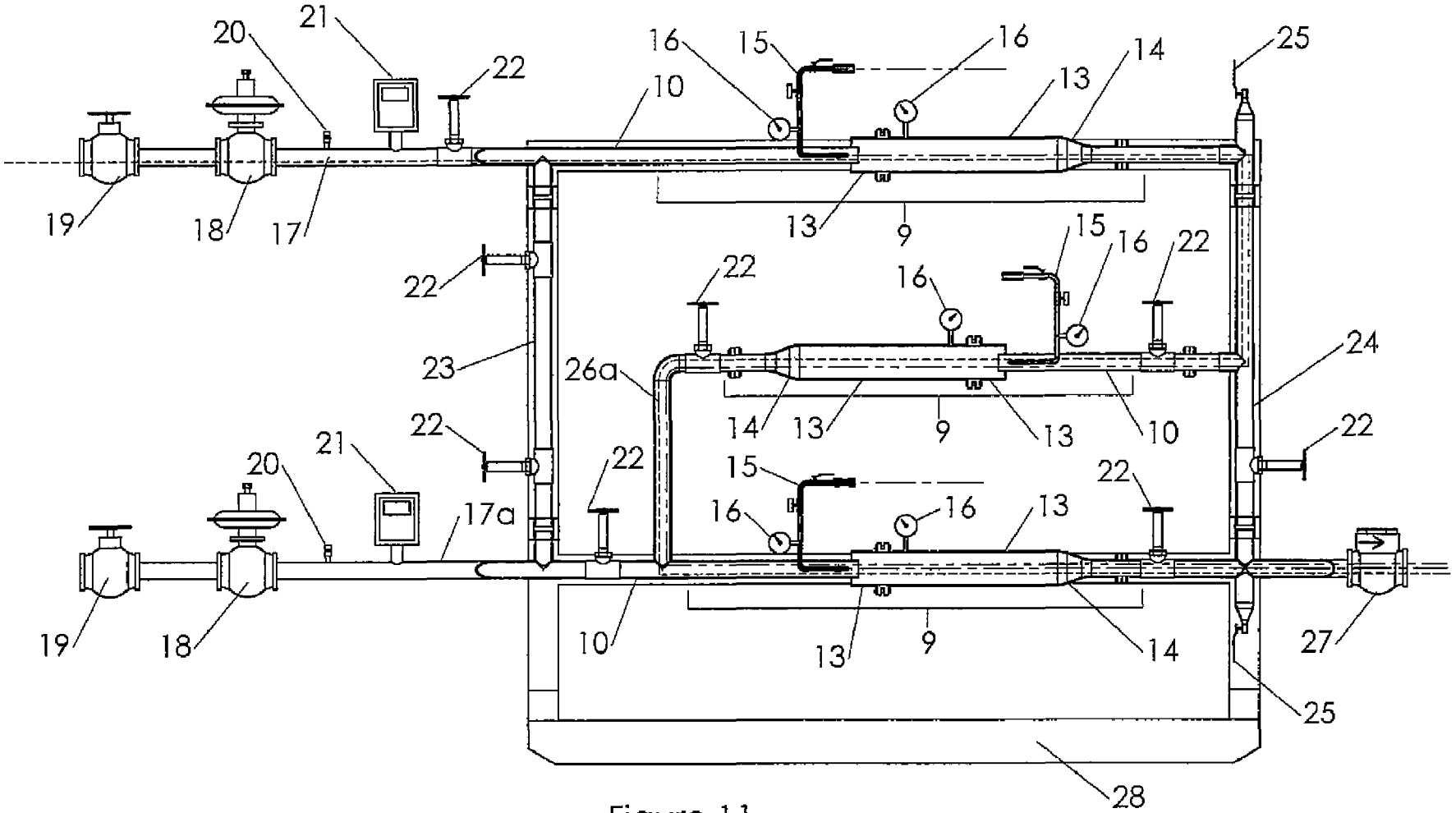
FIG. 11 is a side view of a third embodiment of the present invention showing the injection of two chemicals into a carrier fluid.

FIGS. 10 and 11 illustrate a third embodiment of the present invention. This embodiment is similar to the embodiment shown in FIGS. 4-9, except that a third mixing assembly 9 has been substituted for the horizontal connector arm 26. This configuration provides even greater mixing capability and allows even greater flexibility in terms of possible combinations of carrier fluids and chemicals. For example, in FIG. 11, the carrier fluid is introduced through the first horizontal inlet arm 17, and a first chemical is injected through the injection assembly 15 of the top-most mixing assembly 9. The fluids then travel through the middle (or second) mixing assembly 9, and a second chemical is injected through the injection assembly 15 on the bottom-most mixing assembly 9. In theory, a third chemical could also be added through the injector assembly 15 on the middle mixing assembly 9.

The system also allows for flexibility in that the carrier fluid does not always have to be injected through one of the horizontal inlet arms 17, 17*a*, and the chemical does not always have to be added through an injection assembly 15. For example, if high doses of methanol are desired, the methanol may be introduced through the first horizontal inlet arm 17, and the carrier fluid may be introduced through the injection assembly 15.

Although several preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A mixing device comprising:
(a) a first housing;
(b) a second housing;
(c) a swedge;
(d) an inlet for carrier fluid; and
(e) an inlet for chemicals;
wherein the ratio of the inside diameter of the first housing to the inside diameter of the second housing is 1:2;
wherein the change in diameter between the first and second housing is abrupt;
wherein inside the first housing are an inlet agitator and an injection nozzle;
wherein inside the second housing is a static mixer; and
wherein the swedge is connected to tubing that delivers a mixture of carrier fluid and chemical down a well bore.

2. The mixing device of claim 1, wherein the first and second housing each has an inside diameter, wherein the inside diameter of the first housing is one inch, and wherein the inside diameter of the second housing is two inches.

3. The mixing device of claim 1, wherein the first housing extends into the second housing by a certain distance.

4. The mixing device of claim 1, wherein the first housing extends into the second housing by a distance in the range of one-eighth (⅛) to one and one-half (1½) inches.

5. The mixing device of claim 1, wherein the injection nozzle is located proximate to the point at which the change in diameter occurs between the first and second housing.

6. A method of mixing a carrier fluid with a chemical comprising:
(a) injecting a carrier fluid through the carrier fluid inlet of the mixing device of claim 1; and
(b) injecting a chemical through the chemical inlet of the mixing device of claim 1.

7. A mixing device comprising:
(a) two mixing assemblies;
(b) a horizontal connector arm;
(c) a first horizontal inlet arm; and
(d) a second horizontal inlet arm;
wherein the mixing assemblies are arranged horizontally on a frame, with one mixing assembly on top of the other and the horizontal connector arm between the two mixing assemblies;
wherein one end of each mixing assembly is connected to a first riser and the other end of each mixing assembly is connected to a second riser;
wherein one end of the horizontal connector arm is connected to the second riser and the other end of the horizontal connector arm is connected to a third riser;
wherein the third riser connects the horizontal connector arm to the bottom-most mixing assembly;
wherein the first horizontal inlet arm extends horizontally from the end of the top-most mixing assembly that connects to the first riser; and
wherein the second horizontal inlet arm extends horizontally from the end of the bottom-most mixing assembly that connects to the first riser.

8. The mixing device of claim 7, wherein each mixing assembly comprises:
(a) a first housing;
(b) a second housing; and
(c) a swedge;
wherein the first and second housing each has an inside diameter, wherein the ratio of the inside diameter of the first housing to the inside diameter of the second housing is 1:2;
wherein the change in diameter between the first and second housing is abrupt;
wherein inside the first housing are an inlet agitator and an injection nozzle; and
wherein inside the second housing is a static mixer.

9. The mixing device of claim 8, wherein the first and second housing each has an inside diameter, wherein the inside diameter of the first housing is two inches, and wherein the inside diameter of the second housing is four inches.

10. The mixing device of claim 8, wherein the first housing extends into the second housing by a certain distance.

11. The mixing device of claim 8, wherein the first housing extends into the second housing by a distance in the range of one-eighth (⅛) to two and one-half (2½) inches.

12. The mixing device of claim 8, wherein the injection nozzle is located proximate to the point at which the change in diameter occurs between the first and second housing.

13. The mixing device of claim 8, wherein an injection assembly is attached to the first housing of each mixing assembly, and wherein the injection assembly comprises a check valve, an inlet valve, a needle valve, and the injection nozzle.

14. The mixing device of claim 13, wherein a pressure gauge is attached to each injection assembly.

15. The mixing device of claim 7, further comprising a check valve, wherein the check valve is located opposite the end of the bottom-most mixing assembly from the second horizontal inlet arm, and wherein the check valve is connected to tubing that delivers a mixture of carrier fluid and chemical down a well bore.

16. The mixing device of claim 7, wherein each of the first and second horizontal inlet arms comprises a pressure regulator, a flow control valve, an air/accessory valve, a flow meter, and a block valve.

17. The mixing device of claim 7, wherein each mixing assembly further comprises a pair of primary flanges and a pair of secondary flanges, wherein the horizontal connector arm comprises two pairs of secondary flanges, wherein each pair of flanges is bolted together when the mixing device is assembled; and wherein the flanges can be separated to disassemble the mixing device.

18. The mixing device of claim 7, further comprising a bleeder valve on either end of the second riser.

19. A mixing device comprising:

(a) three mixing assemblies;

(b) a first horizontal inlet arm; and (c) a second horizontal inlet arm;

wherein the mixing assemblies are arranged horizontally on a frame, with one mixing assembly on the bottom, one mixing assembly on the top, and one mixing assembly in the middle of the other two mixing assemblies;

wherein one end of the top-most and bottom-most mixing assemblies is connected to a first riser and the other end of the top-most and bottom-most mixing assemblies is connected to a second riser;

wherein one end of the middle mixing assembly is connected to the second riser and the other end of the middle mixing assembly is connected to a third riser;

wherein the third riser connects the middle mixing assembly to the bottom-most mixing assembly;

wherein the first horizontal inlet arm extends horizontally from the end of the top-most mixing assembly that connects to the first riser; and wherein the second horizontal inlet arm extends horizontally from the end of the bottom-most mixing assembly that connects to the first riser.

20. The mixing device of claim 19, wherein each mixing assembly comprises:

(d) a first housing;

(e) a second housing; and (f) a swedge;

wherein the first and second housing each has an inside diameter, wherein the ratio of the inside diameter of the first housing to the inside diameter of the second housing is 1:2;

wherein the change in diameter between the first and second housing is abrupt;

wherein inside the first housing are an inlet agitator and an injection nozzle; and wherein inside the second housing is a static mixer.

21. The mixing device of claim 20, wherein the first and second housing each has an inside diameter, wherein the inside diameter of the first housing is two inches, and wherein the inside diameter of the second housing is four inches.

22. The mixing device of claim 20, wherein the first housing extends into the second housing by a certain distance.

23. The mixing device of claim 20, wherein the first housing extends into the second housing by a distance in the range of one-eighth (⅛) to two and one-half (2½) inches.

24. The mixing device of claim 20, wherein the injection nozzle is located proximate to the point at which the change in diameter occurs between the first and second housing.

25. The mixing device of claim 20, wherein an injection assembly is attached to the first housing of each mixing assembly, and wherein the injection assembly comprises a check valve, an inlet valve, a needle valve, and the injection nozzle.

26. The mixing device of claim 25, wherein a pressure gauge is attached to each injection assembly.

27. A method of mixing a carrier fluid with one or more chemicals comprising injecting one or more chemicals through one or more of the injection assemblies of the mixing assemblies of the mixing device of claim 13 or 25.

28. A method of mixing a carrier fluid with a chemical comprising injecting the carrier fluid through one or more of the injection assemblies of the mixing assemblies of the mixing device of claim 13 or 25.

29. The mixing device of claim 19, further comprising a check valve, wherein the check valve is located opposite the end of the bottom-most mixing assembly from the second horizontal inlet arm, and wherein the check valve is connected to tubing that delivers a mixture of carrier fluid and chemical down a well bore.

30. The mixing device of claim 19, wherein each of the first and second horizontal inlet arms comprises a pressure regulator, a flow control valve, an air/accessory valve, a flow meter, and a block valve.

31. The mixing device of claim 19, wherein each mixing assembly further comprises a pair of primary flanges and a pair of secondary flanges, wherein each pair of flanges is bolted together when the mixing device is assembled; and wherein the flanges can be separated to disassemble the mixing device.

32. The mixing device of claim 19, further comprising a bleeder valve on either end of the second riser.

33. A method of mixing a carrier fluid with one or more chemicals comprising injecting a carrier fluid through the first or second horizontal inlet arm of the mixing device of claim 7 or 19.

34. A method of mixing a carrier fluid with a chemical comprising injecting the chemical though the first or second horizontal inlet arm of the mixing device of claim 7 or 19.

* * * * *